US005628249A

United States Patent [19]

Cordery et al.

[11] Patent Number: 5,628,249

[45] Date of Patent: May 13, 1997

[54] APPARATUS AND METHOD FOR PREPARING A MAIL PIECE

[75] Inventors: Robert A. Cordery, Danbury; James L. Harman, Southport, both of Conn.

[73] Assignee: Pitney Bowes Inc., Stamford, Conn.

[21] Appl. No.: 364,365

[22] Filed: Dec. 27, 1994

[51] Int. Cl.[6] ..... B41L 47/46

[52] U.S. Cl. ..... 101/91; 400/82; 53/284.3

[58] Field of Search ..... 400/68, 82; 53/131.3, 53/131.4, 131.5, 284.3, 411, 569; 101/91

[56] References Cited

U.S. PATENT DOCUMENTS

| | | | |
|---|---|---|---|
| 4,800,505 | 1/1989 | Axelrod | 364/478 |
| 5,067,305 | 11/1991 | Baker | 53/411 |
| 5,123,757 | 6/1992 | Nagaoka et al. | 400/61 |
| 5,146,544 | 9/1992 | Altham | 395/115 |
| 5,283,752 | 2/1994 | Gombault | 364/478 |
| 5,429,349 | 7/1995 | Supron et al. | 271/199 |

*Primary Examiner*—Edgar S. Burr
*Assistant Examiner*—Steven S. Kelley
*Attorney, Agent, or Firm*—Angelo N. Chaclas; Robert H. Whisker; Melvin J. Scolnick

[57] ABSTRACT

An apparatus and method for producing mail pieces. The apparatus includes a first printer for printing documents and a second printer for printing envelopes and a mail finishing unit for receiving the printed documents from the first printer and the envelopes printed with corresponding addresses from the second printer and inserting the documents into the envelope to form a mail piece. The apparatus operates under the control of a single stream of job data from a host computer, where the job data includes a job header defining default mail piece attributes and mail piece records which include document data and address data, and which may include specific mail piece attribute data for each corresponding mail piece. The apparatus control mechanism partitions the data stream and controls the first printer to print the documents while controlling the second printer to separately print the envelopes which are moved along a separate path to an insert station where the mail piece is formed. Preferably the second printer is an ink jet printer and the apparatus includes a drying buffer to allow time for the printed addresses to dry, and accordingly the apparatus prints several envelopes to load the drying buffer before beginning to print the documents.

14 Claims, 4 Drawing Sheets

APPARATUS AND METHOD FOR PREPARING A MAIL PIECE

BACKGROUND OF THE INVENTION

The subject invention relates to an apparatus and method for producing a mail piece. More particularly, it relates to an apparatus and method for producing mail pieces which apparatus and method are suitable for use with microcomputers and standard word processing software in an office environment.

Many systems for directly producing mail pieces directly from the printed output of a data processing system have been proposed in the past. For example, U.S. Pat. No. 5,283,752; to Gombault et al.; issued Feb. 1st, 1994 discloses a mail preparation system wherein a data processing system controls a linear mail preparation apparatus. The data processing system controls a printer to print documents which, after printing, pass, under the control of the data processing system, through a succession of stations such as a burster, an insert feed station, an address printer, a postage meter and the like. Similarly, U.S. Pat. No. 4,800,505; to: Axelrod et al.; issued Jan. 24, 1989, discloses a system wherein a data processing system prints documents and marks them with an identification code, and simultaneously downloads parameters for controlling the operation of a mail preparation line to a database. As the documents are fed into the mail preparation line, the identification code is scanned and used to access the database to determine the parameters for each mail piece to be produced from the corresponding documents. Other systems for inserting documents into windowed envelopes so that an address printed on the document is visible, or system for printing self-mailer forms which are then folded and sealed to form mail pieces are also known. A system where an envelope form is printed in sequence with documents and later accumulated with the documents, then wrapped around the documents and sealed to form the mail piece is described in U.S. Pat. No. : 5,067,305; issued Nov. 26, 1991; to Baker et al.

While such systems are perhaps suitable for their intended purpose heretofore no system has been available to mailers of moderate size (i.e. who mail on the order of a few thousand pieces a month), who wish to produce high quality mail runs. Systems such as that taught by Gombault et al. and Axelrod et al. are intended for large scale mailers using main frame computers and high capacity inserter systems, while windowed envelopes and self-mailers have an unfortunate "junk mail" aspect.

Where systems for producing mail pieces have printed conventional envelopes they have heretofore printed the envelopes only after the documents are inserted into the envelope; resulting in degradation of print quality from printing on a full envelope, which may vary in thickness, and an increased footprint for the mail production apparatus.

Accordingly, it is an object of the subject invention to provide an apparatus and method for producing moderately sized mail runs of a high quality, and which is suitable for use in an office environment with standard microcomputers and word processing programs.

BRIEF SUMMARY OF THE INVENTION

The above object is achieved and the disadvantages of the prior art are overcome in accordance with the subject invention by means of an apparatus and method for producing a mail piece, wherein the apparatus includes a first printer for printing a document and a mail finishing unit for receiving the document from the first printer and inserting the document into an envelope to form a mail piece. The mail finishing unit includes a second printer for printing an address on the envelope prior to insertion of the document into the envelope. The apparatus also includes a controller which is responsive to mail piece data; the mail piece data including first data for defining the document and second data for defining the address to be printed on the document. In accordance with the method of the subject invention the document is printed in the first printer and the envelope is printed with the corresponding address in the second printer prior to insertion of the document into the envelope and the printed document and printed envelope are fed along separate paths to an inserter where the document is inserted into the envelope.

In accordance with one aspect of the subject invention the second printer prints at a slower rate then the first printer; the slower rate being selected to be fast enough so that printing of the envelope does not limit the throughput of the apparatus.

In accordance with another aspect of the subject invention the apparatus comprises a buffer station for receiving the printed envelope from the second printer and buffering (i.e. delaying) the printed envelope as it is transported to the inserter to allow the printed address to dry.

In accordance with another aspect of the subject invention the second printer prints the envelope before the first printer prints the document.

It has been found that the novel architecture of the claimed apparatus wherein the envelope is printed prior to insertion of the printed documents, while empty (that is before any pre-printed inserts or business return envelopes are inserted) has proven advantageous in providing higher quality printing of the address and in reducing the footprint of the apparatus.

Other advantages and objects of the invention will be apparent to those skilled in the art from consideration of the attached drawings and of the detailed description set forth below.

DETAILED DESCRIPTION OF PREFERRED EMBODIMENTS OF THE SUBJECT INVENTION

Figure 1:
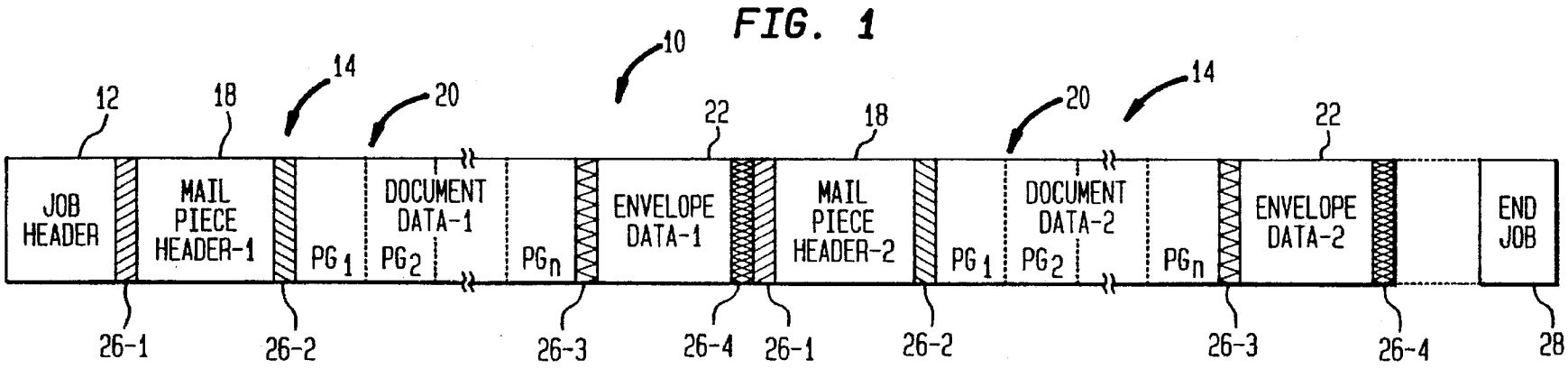
FIG. 1 is a schematic representation of job data defining a mailing job.

In FIG. 1 a schematic representation of job data 10 for controlling an apparatus in accordance with the subject invention to produce a mailing job, i.e. a sequence of mail pieces, is shown. Job data 10 includes job header 12 and a sequence of mail piece records 14, each corresponding to a mail piece to be produced in the job. Job header 12 defines default attributes for each mail piece in the job; including the number of document sheets to be accumulated for each mail piece, whether or not a pre-printed insert is to added to the document sheets, the manner in which the accumulated sheets are to be folded, whether or not a BRE (i.e. business return envelope) is to be inserted into the envelope with the folded accumulation, and whether or not the mail piece is to be moistened and sealed.

Preferably job header 12 also defines a job type: whether not envelope data is present (i.e. if a window envelope is to be used), whether all mail pieces include a uniform number of documents, and whether or not inserts vary among the mail pieces; as well as an optional job name to be displayed while the job runs. Job type data allows the system to anticipate simpler jobs (e.g. there is no need to execute code associated with envelope printing if the job type defines a window envelope) and confirms that the absence of unneeded attribute data is not an error.

Each of records 14 corresponds to one mail piece to be produced, and includes mail piece header 16, document data field 20, and envelope data field 22. Mail piece header 18 includes the same (or a subset of the) data elements included in job header 12 to define the mail piece attributes specific to the corresponding mail piece. (It should be noted that it is anticipated that most mailing jobs will not vary the attributes of mail pieces, that is each mail piece will have the same number of sheets folded in the same manner and include the same inserts, etc. Accordingly, the mail piece header can be omitted and is disclosed here only for the sake of completeness and forms no part of the subject invention as claimed.)

Document data 20 includes a sequence of document pages to be printed by the document printer as will be described below. It is a particular advantage of the subject invention that document data 20 can be completely compatible with standard laser printers and the output of standard word processing programs and described in a conventional page description language such as the Hewlett Packard PCL5 language, or equivalent. Envelope data field 22 includes an address to be printed on the envelope. Preferably this address will be extracted from document data by the host computer in any convenient manner such as the identification of address fields in the document data, as will be described further below.

Fields 18, 20 and 22 are separated by unique separators 26-1, 26-2, 26-3 and 26-4 and data 10 also includes an End of Job marker 28 to identify the end of the job.

Figure 2:
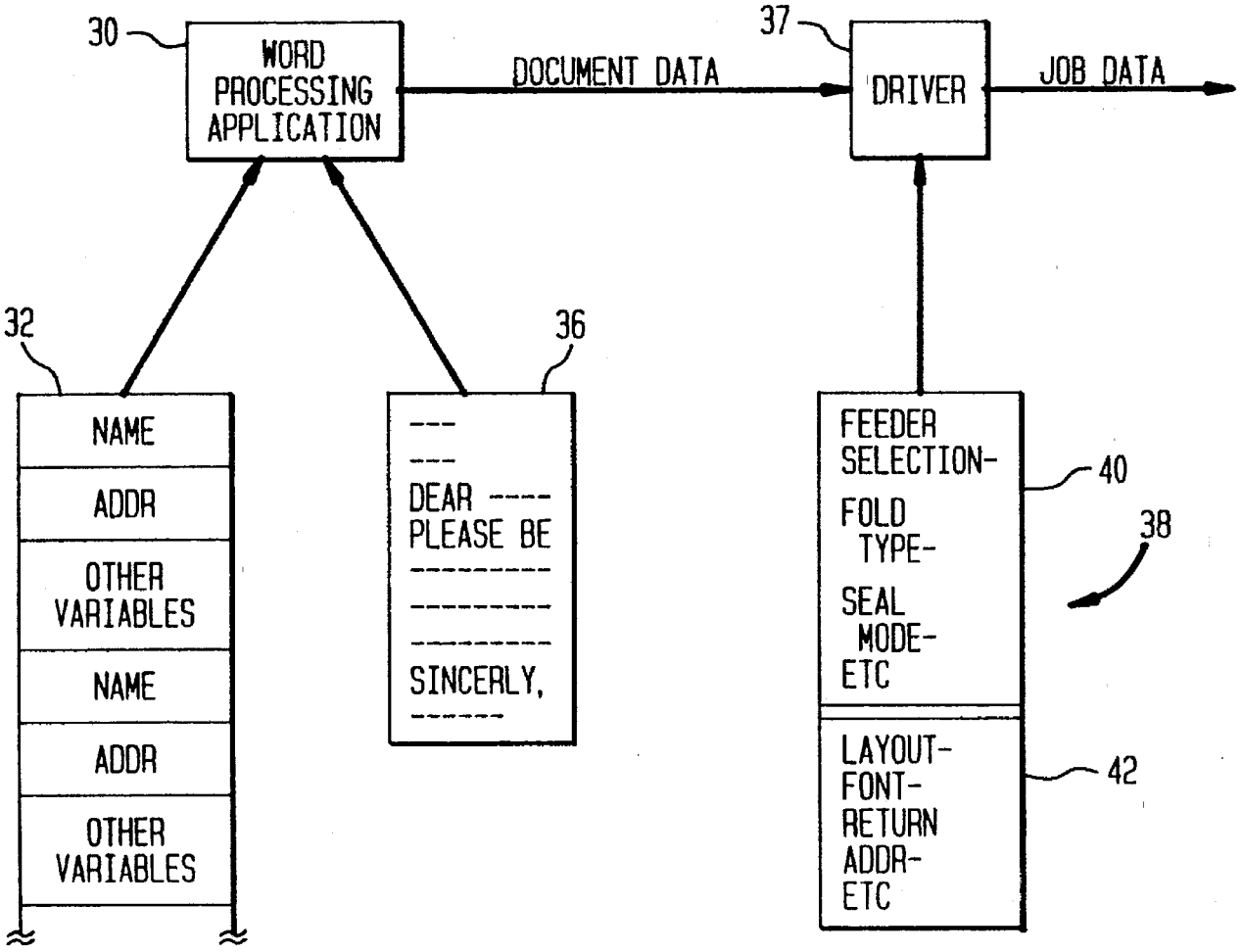
FIG. 2 is a schematic representation of the data flow in a host computer in producing the job data of FIG. 1.

FIG. 2 shows the data flow in a host computer, which is preferably a microcomputer of the type commonly used in an office environment, in creating job data 10. A commercial word processing program, such as that sold under the trade name "Word" by the Microsoft Corporation, executes a conventional merge application to merge variable data 32, which includes name, address and other variables to be printed on the documents with a predetermined form 36 to create document data. The document data is input to driver 37 and driver 37 creates the job data by extracting an address from the document data and accessing data store 38 to define the mail piece attributes.

Driver 37 extracts the address from the document data in any convenient conventional manner, such as by the use of a predetermined field within the document data, or the use of an algorithm based upon the detection of alphanumeric combinations typical of zip codes, state names, city names, etc., as is also known. Driver 37 also accesses data store 38 to obtain the attribute information which includes processing attributes 40, such as feeder selection, fold type, sealing mode etc. Preferably driver 37 also gets job type data 42 from data store 38 for inclusion in job header 12. Driver 7 then adds separators 26-1 through 26-4 to create header 12 and records 14, as described above. As noted, generally each mail piece in a mailing job will be produced in an identical manner and the default values used for each mail piece. Accordingly, mail piece header 18 can be filled will null data or with copies of job header 12. However, if it is desired to produce mailing jobs having mail pieces with varying attributes it would be well within the skill of a person of ordinary skill in the programming ads to modify a word processing application or produce a special application which would generate varying data for mail piece header 18.

Figure 3:
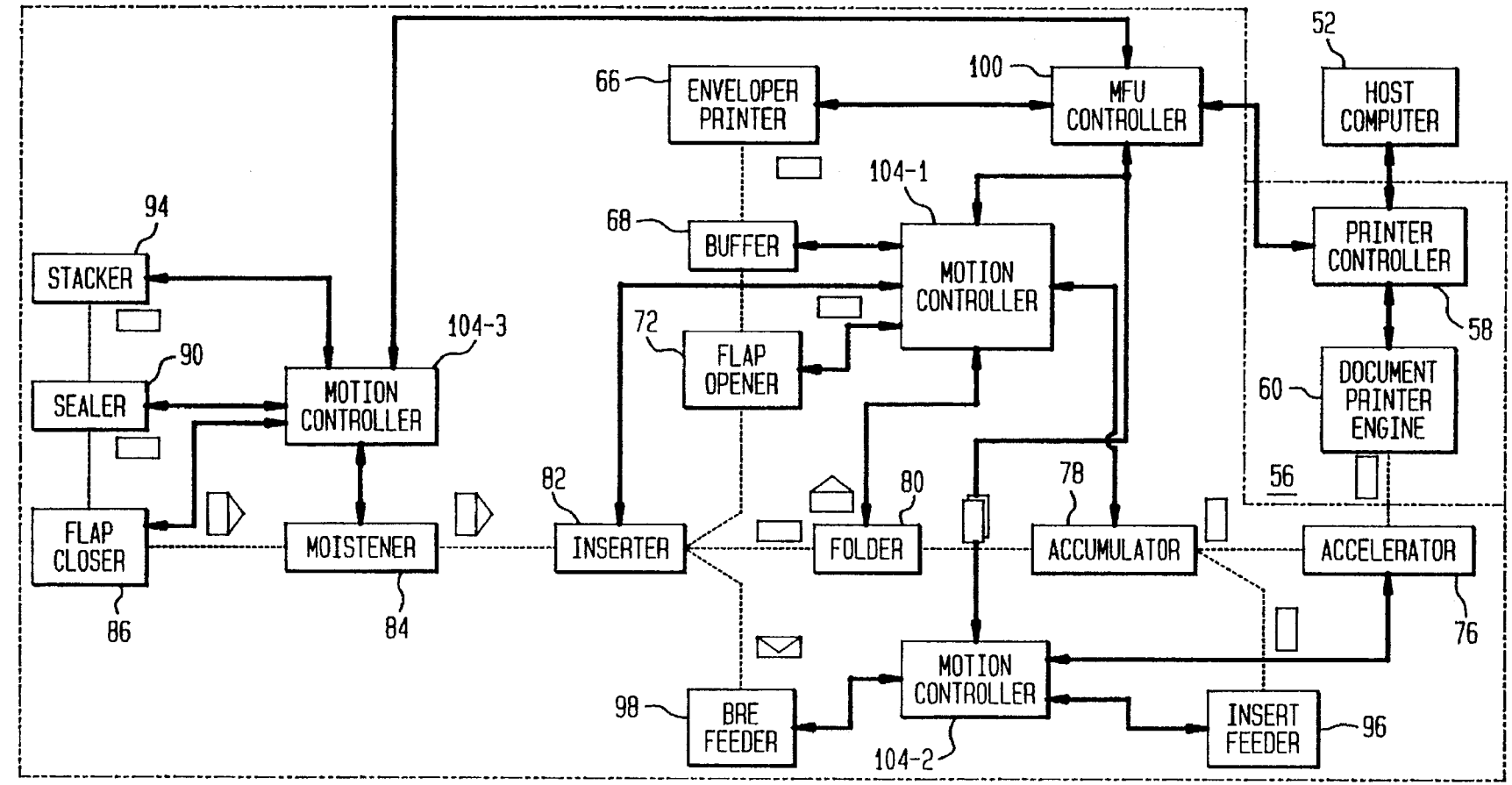
FIG. 3 is a schematic block diagram of an apparatus in accordance with the subject invention.

Turning to FIG. 3, apparatus 50 is connected to host computer 52 to receive job data which is generated as described above. Apparatus 50 includes document printer 56, which is preferably a laser printer including printer controller 58 and a conventional document printer engine 60, which is preferably a Canon model LBP-NX, and a mail finishing unit 64 which receives the printed documents from printer engine 60 and inserts them into envelopes to form mail pieces in accordance with the mail piece data, as will be described below. Note that it is a particular advantage of the subject invention that host computer 52 connects to document printer 56 in a manner which is substantially identical to the manner in which microcomputers connect to conventional laser printers, and which requires only the minor software modification to add address data and attribute data to the document data, which is produced by conventional word processing software.

Printer controller 58 receives job data 10 from host computer 52 and parses the data; sending the attribute data from either job header 12 or mail piece header 18 to mail finishing unit controller 100, and sending document data 20 to document printer engine 60, as will be described further below. Mail finishing unit controller 100 stores mail piece attributes 40 from job header 12 for default control of the production of each mail piece and downloads common elements of the address to be printed on the envelopes to envelope printer 66. Preferably envelope printer 66 includes an integral controller which will render the text characters received from mail finishing unit controller 100 into appropriate control signals to render an image of the address in accordance with the address data, the font, the layout etc.

Envelope printer 66 is also preferably an ink jet printer and the printed envelopes are output from printer 66 to a drying buffer station 68 which extends the transport time of a succession of envelopes as they are output by envelope printer 66 to allow the printed address time to dry. Since a number of envelopes, preferably up to 6, are stored in buffer 68 printer controller 58 does not forward documents for printing to printer engine 60 until buffer 68 is loaded. That is, until drying buffer 68 is either filled to capacity or until an End of Job (EOJ) code is detected and the system knows that the last envelope is in buffer 68.

After the printed address has dried on the envelope the envelope proceeds to flap opener station 72 where the envelope flap is opened prior to insertion of the documents and possibly other items.

When drying buffer 68 is loaded printer controller 58 outputs a page of document data to document printer engine 60 which prints that page in a conventional manner. As the page is printed it is received by accelerator station 76, and as printer engine 60 releases the printed page accelerator station 76 accelerates the page to the faster speed at which mail finishing unit 64 operates.

Accelerator station 76 then transfers the printed page to accumulator station 78 and, if a plurality of pages are to be included in the mail piece the above described operations are repeated until all the document pages are in accumulator station 78. If the mail piece attributes specified for the mail piece include a preprinted insert such a preprinted insert may be fed from insert feeder 96 to accumulator station 78 since the higher operating speed of a mail finishing unit 64 will allow time for this without slowing the operation of document printer engine 60.

Once completed the accumulation of printing document pages and any preprinted inserts are transferred from accumulator station 78 to folder station 80 where the accumulation is folded into either a "C" or "Z" fold as specified in the mail piece attributes. Once the folded accumulation is present at folder station 80 the envelope, with its flap open, is fed (or has been fed) to inserter station 82 and the folded accumulation is transferred from folder station 80 to inserter station 82 for insertion into the envelope. If specified by the mail piece attributes a BRE is fed from BRE feeder 98 and also inserted into the envelope.

The mail piece (i.e. the envelope with all printed documents and any preprinted inserts and BRE's inserted) is fed from inserter station 82 to moistener station 84 where the envelope flap is moistened if the mail piece is to be sealed. The mail piece then proceeds to flap closer station 86, sealer 90 and output stacker 94 where the completed mail piece, including all preprinted inserts and BRE's, with an address and possible return address printed on a conventional envelope, and which has been sealed if so specified, is output for franking with the proper postage and delivery to the postal service.

The various stations described in mail finishing unit 64 perform functions which are well known in the mail preparation art and implementation of such stations would be well within the skill of those of ordinary skill in the mail preparation arts.

In a preferred embodiment of the subject invention drying buffer 68 is formed as an arrangement of four helical screws arranged to support an envelope and transport the envelope as the screws rotate, as described in commonly U.S. Pat. No. 5,429,349, which is hereby incorporated by reference.

Figure 4:
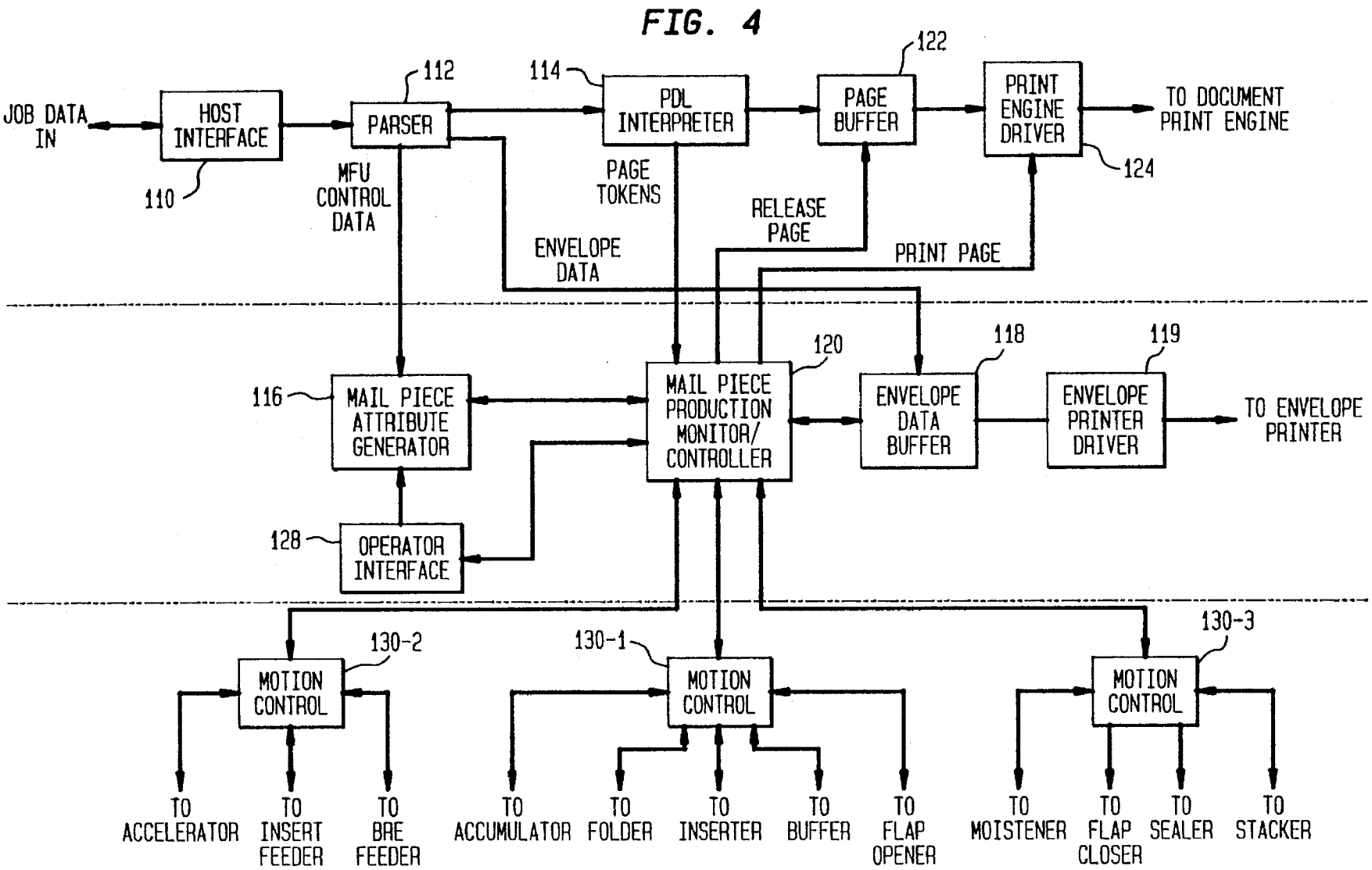
FIG. 4 is a schematic representation of the flow of control data in the apparatus of FIG. 3.

Turning to FIG. 4 the operation of apparatus 50 is controlled in accordance with job data 10 by the execution of various software modules resident in printer controller 58, mail finishing unit controller 100, and motion controllers 104-1, 104-2 and 104-3. It should be noted that the partitioning of these modules among the various controllers forms no part of the subject invention as claimed and that, in principal, all the functions of apparatus 50 could be controlled by a single controller of sufficient capacity.

Job data 10 is input from host computer 52 to host interface 110, which is resident in printer controller 58. Interface 110 is preferably a standard interface for managing a serial protocol such as the RS 232 protocol, or a standard parallel or network protocol. Job data 10 is then transferred to parser 112 which outputs document data from field 20 to page description language (PDL) interpreter 114 and envelope data from field 22 to envelope data buffer 118 in mail finishing unit controller 100. Parser 112 also outputs mail finishing unit control data, which is default attribute data from job header 12 or specific mail piece attribute data from mail piece header 18, and the EOJ to mail piece attribute generator 116.

Mail piece attribute generator 116 receives the mail finishing unit control data which is expressed as codes descriptive of a mail piece; (e.g. codes which would describe a mail piece having 1 printed page, a preprinted insert, no BRE, which is to be sealed) and converts these descriptive codes into commands for the operation of the various stations and printers in mail finishing unit 64. Default commands are stored permanently for the duration of a job while commands found in mail piece header 18 are stored only for the production of a corresponding mail piece. Preferably common information for printing the envelopes is transferred to the integral controller of envelope printer 66. Mail piece attribute generator 116 also responds to the EOJ code to identify the last mail piece to assure that the mailing job is properly terminated and the last mail piece completed.

Returning to interpreter 114, the document data, which is expressed in a conventional page description language such as PCL5 is interpreted at 114 in a conventional manner into an appropriate set of printer commands to drive the print engine used. As each page is translated it is stored in page buffer 122. Such interpretation and buffering of document pages is conventional in the laser printing art and need not be described further here for an understanding of the subject invention except to note that buffer 122 is substantially larger than is normally found in a commercial laser printer for office use since it is desirable that pages be stored until a mail piece is output from apparatus 50 to facilitate recovery from jam conditions. Also pages for several mail pieces may need to be stored until drying buffer 68 is initially filled and the first envelope is available at insert station 82, as well as to provide for error conditions, as will be described below.

Once the first envelope is available data is transferred from page buffer 122 to print engine driver 124 which renders the print commands into appropriate control signals to generate an image of the page at document printer engine 60.

Also as each page is interpreted interpreter 114 transmits a page token to mail piece production monitor/controller 120 which is resident in mail finishing unit controller 100. Monitor/controller 120 updates these tokens as pages move through mail finishing unit 64 to track the pages and to facilitate recovery from jam conditions.

When monitor/controller 120 detects the presence of envelope data in buffer 118 it transfers the envelope data to envelope print driver 119 which controls envelope printer 66 to print the envelope data on the envelope in accordance with the previously determined attribute data defining the common elements of the envelope address. It should be noted that, since envelope printer 66 includes an integral controller, driver 119 is substantially simpler than driver 124. And, as with print engine driver 124, the control of envelope printer 66, which is preferably an ink jet printer, is conventional and need not be described further here for an understanding of the subject invention except to note that buffer 118 is also somewhat larger than normal so that envelope data may also be recovered in the case of a jam.

Mail piece production monitor/controller 120 will then continue to print envelope data from buffer 118 as it is available until drying buffer 68 is loaded; that is until buffer 68 is completely full or an EOJ code is detected and monitor/controller 120 recognizes that the last envelope is in drying buffer 68. Then, when drying buffer 68 is loaded monitor/controller 120 signals page buffer 122 to release the next page to engine driver 124, and when document printer engine 60 is ready signals driver 124 to print the page. If multiple pages of documents are to be included in a mail piece, as defined by the mail piece attributes generated at 116, monitor/controller 120 continues to release pages from buffer 122 until ell pages for a mail piece are printed.

Once monitor/controller 120 has released the last page for a mail piece it determines if the EOJ code has been detected and the last envelope is in drying buffer 68. If not the next envelope data in buffer 118 is printed and drying buffer 68 is advanced and pages for the next document are released from buffer 122, as described above. Once the EOJ code is detected and monitor/controller 120 recognizes that the last envelope has been printed and is in drying buffer 68 monitor/controller 120 will cease printing envelopes but will continue to release pages from page buffer 122 until the last envelope is fed from drying buffer 68 to inserter station 82 so that the last mail piece in a mailing job is properly processed through mail finishing unit 64.

As pages are released from document printer engine 60 they are processed through mail finishing unit 64 as described above. Monitor/controller 120 accesses the mail piece attributes generated at 116 and issues appropriate commands to motion controllers 104-1, 104-2 and 104-3 to control the various stations appropriately to produce mail pieces having the desired attribute. These commands are received by motion control software 130-1, 130-2 and 130-3, which are resident in corresponding motion controllers while 104-1, 104-2 and 104-3 and which generate appropriate control signals for various motors and actuators in mail finishing unit 64 and which monitor various sensors in unit 64 to produce a mail pieces having the desired attributes. Detailed design of the motion controllers and associated software will depend in general on the detailed design of the various stations of mail finishing unit 64 but is well within the skill of a person of ordinary skill in the digital control ads as they are applied to the mail processing art. A particularly suitable form of motion controller wherein identical motion control software can be adapted to various stations by downloading of appropriate data is described in commonly assigned, copending U.S. patent application 08/327,246; filed Sep. 29, 1994 which is hereby incorporated by reference.

In the preferred embodiment shown, motion control software 130-1 controls accumulator station 78, folder station 80, inserter station 82, drying buffer 68 and flap opener 72; motion control software 130-2 controls accelerator 76, insert feeder 96 and BRE feeder 98; and motion control software 130-3 controls moistener 84, flap closer 86, sealer station 90 and stacker 94. In general this partitioning of control functions is chosen to simplify wiring of mail finishing unit 64 and to minimize the need for time critical transfers of information between controllers, and forms no part of the subject invention as claimed.

In the preferred embodiments shown no physical buffering of printed documents is provided. Further, as is known to those skilled in the art, for safety reasons relating to the hazards of halting a laser printer with a document in the fuser, many laser print engines cannot be stopped once they have begun printing a sequence of documents. This implies that no gaps should be allowed in the sequence of envelopes in drying buffer 68.

This problem can arise in two ways. In one, the host may cease transmission of mail piece data after, laser printer 56 has began to print a series documents. Since printing of the documents cannot be stopped the corresponding envelopes must be fed from drying buffer 68, which could create gaps in the sequence of envelopes without new data from host 52. To overcome this page buffer 122 and envelope data buffer 118 store sufficient additional mail piece data to allow envelope printer 66 to continue printing envelopes to keep drying buffer 68 full if host 52 ceases transmitting when laser printer 56 is committed to print documents for a maximum number of mail pieces; typically three mail pieces. Printing does not begin until sufficient mail piece data is in buffers 118 and 122 so that if, for any reason, host 52 ceases to transmit mail piece data drying buffer 68 can be kept full until laser printer 56 has printed all documents begun and operations can be stopped until host 52 resumes transmission.

Another way a problem with keeping drying buffer 68 full can arise, is if printer 66 cannot convert particularly complex envelope data into appropriate printer commands before the next envelope is needed to form the next mail piece. To overcome this problem envelope printer 66 signals mail finishing unit controller 100 approximately halfway through the rendering process, and if controller 100 estimates that the envelope cannot be printed before the next envelope is needed out of drying buffer 68, the envelope which will be late is not sent to buffer 68, the mail pieces in process are completed, emptying buffer 68, and the production process is reinitiated beginning with the late envelope and associated mail piece when buffer 68 is empty.

The above description of preferred embodiments of the subject invention has been given by way of illustration only, and numerous other embodiments of the subject invention will be apparent to those skilled in the art from consideration of the above description and the attached drawings. Accordingly limitations on the scope of the subject invention are to found only in the claims set forth below.

What is claimed is:

1. An apparatus for producing a mail piece, said apparatus comprising:

a) a first printer for printing a document;

b) mail finishing means for receiving said document from said first printer and for inserting said document into an envelope to form said mail piece, said mail finishing means including a second printer for printing an address on said envelope prior to insertion of said document into said envelope;

c) control means responsive to mail piece data for controlling said apparatus to produce said mail piece in accordance with said mail piece data; said mail piece data including first data defining said document, and second data defining said address;

d) a buffer station for buffering said envelope to allow said address to dry after printing; and e) data storage buffer means for storing sufficient mail piece data to allow said envelope printer to continue printing envelopes for input to said buffer station while said first printer completes a sequence of documents if the input of mail piece data is interrupted; whereby gaps in the sequence in said buffer station are prevented.

2. An apparatus as described in claim 1 wherein said second printer operates at a slower printing rate than said first printer, said slower printing rate of said second printer being at least sufficiently fast that it does not substantially limit the average processing rate of said apparatus.

3. An apparatus as described in claim 2 wherein said second printer is an ink jet printer.

4. An apparatus as described in claim 2 wherein said second printer prints said envelope prior to said first printer printing said document.

5. An apparatus as described in claim 1 wherein said second printer is an ink jet printer.

6. An apparatus as described in claim 1 wherein said second printer prints said envelope prior to said first printer printing said document.

7. An apparatus as described in claim 1, further comprising:

a) a controller for said mail finishing unit; wherein, said controller responds to an indication that an address to be printed on the next envelope to be input to said buffer station cannot be finished printing before the next envelope to be output from said buffer station is needed to form the next mail piece to stop said next envelope to be printed before it is input to said buffer station, complete processing of all mail pieces in process to empty said buffer station, and reinitialize operation of said apparatus beginning with said next envelope to be printed; whereby gaps in the sequence of envelopes in said buffer are prevented.

8. An apparatus as described in claim 1 wherein:

said mail piece data further includes third data defining mail piece attributes, said control means further for parsing said first data to said first printer for printing said document, said second data to said second printer for printing said envelope and said third data to said mail finishing means for use in producing said mail piece; and wherein said third data includes information indicating a number of sheets contained in said document and a manner of folding said document.

9. An apparatus as described in claim 4 wherein:

said mail piece data further includes third data defining mail piece attributes, said control means further for parsing said first data to said first printer for printing said document, said second data to said second printer for printing said envelope and said third data to said mail finishing means for use in producing said mail piece; and wherein said third data includes information indicating a number of sheets contained in said document and a manner of folding said document.

10. An apparatus as described in claim 7 wherein:

said mail piece data further includes third data defining mail piece attributes, said control means further for parsing said first data to said first printer for printing said document, said second data to said second printer for printing said envelope and said third data to said mail finishing means for use in producing said mail piece; and wherein said third data includes information indicating a number of sheets contained in said document and a manner of folding said document.

11. A method for producing a mail piece, said method comprising the steps of:

a) printing a document in a first printer;

b) printing an address on an envelope in a second printer;

c) feeding said envelope along a first path and feeding said document along a second, intersecting path, d) buffering said envelope to allow said address to dry after printing;

e) storing sufficient mail piece data to allow said envelope printer to continue printing envelopes for input to said buffer station while said first printer completes a sequence of documents if the input of mail piece data is interrupted; whereby gaps in the sequence of envelopes in said buffer station are prevented; and f) receiving said envelope and said document at an intersection of said paths and inserting said document into said envelope.

12. A method as described in claim 11 further comprising the step of delaying said envelope as it is fed along said first path to allow said address to dry after printing.

13. A method as described in claim 11 wherein said second printer operates at a lower printing rate than said first printer, said lower rate being at least sufficiently great that it does not substantially limit the average processing rate of said apparatus.

14. A method as described in claim 11 wherein said envelope is printed prior to printing said document.

* * * * *